US006514607B1

(12) United States Patent
Oue et al.

(10) Patent No.: US 6,514,607 B1
(45) Date of Patent: Feb. 4, 2003

(54) MACHINE SEWING THREAD

(75) Inventors: Kazuto Oue, Takatsuki (JP); Keiko Yoneda, Kyoto (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 09/979,600

(22) PCT Filed: May 26, 2000

(86) PCT No.: PCT/JP00/03417

§ 371 (c)(1),
(2), (4) Date: Nov. 26, 2001

(87) PCT Pub. No.: WO00/73553

PCT Pub. Date: Dec. 7, 2000

(30) Foreign Application Priority Data

May 27, 1999 (JP) ..... 11-147700

(51) Int. Cl.[7] ..... D01F 6/00
(52) U.S. Cl. ..... 428/364; 428/395
(58) Field of Search ..... 428/364, 395; 57/14, 26, 903

(56) References Cited

U.S. PATENT DOCUMENTS 6,284,370 B1 * 9/2001 Fujimoto et al. ..... 428/364

FOREIGN PATENT DOCUMENTS

| | | |
|---|---|---|
| EP | 0 547 553 A1 | 6/1993 |
| JP | 06248529 A | 9/1994 |
| WO | WO 96/00808 | 1/1996 |

* cited by examiner

*Primary Examiner*—N. Edwards
(74) *Attorney, Agent, or Firm*—Finnegan, Henderson, Farabow, Garrett & Dunner, L.L.P.

(57) ABSTRACT

The present invention provides a sewing thread formed from poly(trimethylene terephthalate) multifilament yarns, the sewing thread being characterized in that the sewing thread shows a stress at a 5% elongation of a tensile elongation curve of from 0.4 to 1.2 cN/dtex and a stress at a 30% elongation of from 1.4 to 2.2 cN/dtex, a method of producing the same, and fabric sewn articles prepared using the same.

The sewing thread of the present invention is a stretchable one that is excellent in sewing performance, and the seam prepared using the same has a good appearance and shows excellent stretchability. Moreover, the sewn articles thus obtained do not constrain the wearers, and give the wearers a significantly comfortable feel.

10 Claims, No Drawings

MACHINE SEWING THREAD

TECHNICAL FIELD

The present invention relates to a sewing thread having stretchability and to sewn articles prepared using the sewing thread.

BACKGROUND ART

For example, when a fabric having stretchability is sewn with a commonly used sewing thread having no stretchability, it has heretofore been natural that the stretchability of the fabric in the seamed portions is lowered, and the advantage of the fabric has not been utilized. Moreover, when an excessive elongating force is applied to the seams of a sewn stretchable fabric, the sewn fabric has a disadvantage that the sewing thread having no stretchability is easily broken.

Accordingly, when stretchability must be given to the seams, the following has been practiced: the stretchability of the seams is manifested by forming seams having a structure of a multi-thread chain stitch, an overlock stitch or a zigzag stitch. However, these seams have the following drawbacks: a special sewing machine is required in order to form the structures; formation of the seams requires much time; a large amount of a sewing thread is used; and the seams have a poor appearance. Moreover, the stretchability of the fabric in the seamed portions is not necessarily satisfactory.

Japanese Unexamined Patent Publication (Kokai) No. 1-260030 and No. 2-26945 propose sewing threads used for sewing stretchable fabrics. These known sewing threads are prepared by doubler-twisting an elastic yarn such as a polyurethane-based yarn and a soluble yarn or covering an elastic yarn with a soluble yarn. In a sewing method using the sewing threads, elastic yarns alone are left in the stitched portions by dissolving and removing the soluble yarns after sewing. In these proposals, an attempt is made to solve the following problems of the sewing method using an elastic yarn alone, by doubler and twisting an elastic yarn and a nonelastic soluble yarn in combination or covering an elastic yarn with a nonelastic soluble yarn so that elongation of the elastic yarn is suppressed and the friction resistance is decreased during sewing: the sewing performance is poor; puckering is produced; and the sewn appearance is poor. However, this sewing method has the following disadvantages: in order to manifest the elasticity of the elastic yarn, the step of dissolving and removing the soluble yarn is required so that the sewing cost is increased; and perforations clearly remain in the stitched portions of sewn articles to impair the sewn appearance.

On the other hand, Japanese Unexamined Patent Publication (Kokai) No. 5-321066 discloses, as a composite sewing thread that is excellent in high speed sewing performance and that forms seams excellent in tenacity and appearance, a composite sewing thread that is formed from a composite yarn prepared by covering as a core yarn a high tenacity filaments synthetic yarn such as a poly(ethylene terephthalate) yarn by staple fibers; the core yarn has a breaking strength of 7.5 g/d (6.6 cN/dtex) or more, a dry heat shrinkage of 4% or less at 150° C., and a stress at a 5% elongation of 2.0 g/d (1.8 cN/dtex) or more. However, since the known composite sewing thread has no elastic stretchability, the sewing thread has the same disadvantages as those of the above common sewing threads that have no elastic stretchability. Moreover, according to the study of the present inventors, it has been significantly difficult to obtain a high strength poly(trimethylene terephthalate) yarn that has a breaking strength of 6.6 cN/dtex or more although there is no description in the patent publication that suggests a poly(trimethylene terephthalate) yarn.

DISCLOSURE OF THE INVENTION

An object of the present invention is to provide a stretchable sewing thread that can be used for forming lock stitch having a high stretchability, and a sewn article prepared from a stretchable fabric and having seams that have an excellent appearance and stretchability.

The present inventors have discovered that a sewing thread showing an elongation at a lower stress and an excellent elastic recovery at a high elongation can be obtained by subjecting a yarn obtained by double and twisting two to several poly(trimethylene terephthalate) multifilament yarns that have specific physical properties and specifications which will be described later to a wet heat relaxation treatment under specific conditions to cause uniform fine structural changes, namely, structural relaxation to the constituent filaments.

Furthermore, the present inventors have found that a sewing thread obtained by such a method as explained above and showing specific tensile elongation characteristics has an excellent stretchability and can solve the problems mentioned above, and thus achieved the present invention.

That is, the present invention provides a sewing thread formed from poly(trimethylene terephthalate) filaments yarns, the sewing thread being characterized in that the sewing thread shows a stress at a 5% elongation of a tensile elongation curve of from 0.4 to 1.2 cN/dtex and a stress at a 30% elongation of from 1.4 to 2.2 cN/dtex.

The present invention further relates to a sewn article prepared by sewing a fabric using such a sewing thread.

The present invention will be explained below in detail.

In the present invention, a poly(trimethylene terephthalate) yarn designates a yarn composed of a polyester that has trimethylene terephthalate repeating units as principal repeating units and that contains the trimethylene terephthalate units in an amount of about 50% by mol or more, preferably 70% by mol or more, more preferably 80% by mol or more, still more preferably 90% by mol or more. The poly(trimethylene terephthalate) yarn according to the present invention therefore includes a polyester yarn composed of poly(trimethylene terephthalate) that contains as a third component of the polyester other acid components and/or glycol components in a total amount of about 50% by mol or less, preferably 30% by mol or less, more preferably 20% by mol or less, still more preferably 10% by mol or less.

Poly(trimethylene terephthalate) is synthesized by combining terephthalic acid or its functional derivative and trimethylene glycol or its functional derivative in the presence of a catalyst under suitable reaction conditions. In the course of the synthesis, one or two or more suitable third components may also be added to form a copolymerized polyester.

Examples of the third components to be added include aliphatic dicarboxylic acids such as oxalic acid and adipic acid, alicylic dicarboxylic acids such as cyclohexanedicarboxylic acid, aromatic dicarboxylic acids such as isophthalic acid and sodium sulfoisophthalate, aliphatic glycols such as ethylene glycol, 1,2-propylene glycol and tetramethylene glycol, alicyclic glycols such as cyclohexanedimethanol, aliphatic glycols each having an aromatic group such as 1,4-bis(β-hydroxyethoxy) benzene, polyether glycols such as polyethylene glycol and polypropylene glycol, aliphatic oxycarboxylic acids such as (ω-oxycaproic acid and aromatic oxycarboxylic acid such as p-oxybenzoic acid. Moreover, a compound having one or three or more ester-forming functional groups such as benzoic acid or glycerin may also be employed so long as the resultant polymers are substantially linear.

The poly(trimethylene terephthalate) yarn used in the present invention is generally a yarn produced by melt spinning the poly(trimethylene terephthalate) polymer explained above. The poly(trimethylene terephthalate) yarn may also be a yarn produced by separately synthesizing such a polyester other than poly(trimethylene terephthalate) as poly(ethylene terephthalate), nylon and poly(trimethylene terephthalate), and blending the polymers (polymer blending); the yarn may also be one produced by composite spinning (sheath core, side-by-side or the like).

The poly(trimethylene terephthalate) yarn herein may contain delustering agents such as titanium dioxide, stabilizing agents such as phosphoric acid, ultraviolet-ray absorbers such as a hydroxybenzophenone derivative, nucleating agents such as talc, lubricants such as Aerosil, antioxidants such as a hindered phenol derivative, flame retardants, antistatic agents, pigments, fluorescent brighteners, infrared-ray absorbers, defoaming agents and the like.

The poly(trimethylene terephthalate) yarn forming the sewing thread of the invention can be obtained by any of the following methods: a method wherein the poly(trimethylene terephthalate) explained above is melt spun, the spun yarn is wound at a speed of about 1,500 m/min to give an undrawn yarn, and the undrawn yarn is drawn and twisted by a factor of about 2 to 3.5; a direct drawing method (spin-draw take-up method) in which a spinning step and a drawing are directly connected; a high speed spinning method (spin take up method) in which the winding speed is set at 5,000 m/min or more; and a method wherein the melt spun yarn is once cooled in a water bath, and the cooled yarn is drawn.

In this case, the shape of the filamentary yarn is a (multifilament yarn). The cross-sectional shape of a filament forming the multifilament yarn may be polygon-shaped, for example, round-shaped, triangle-shaped, L-shaped, T-shaped, Y-shaped, W-shaped, eight-leaf-shaped, flat-shaped and dog-bone-shaped, multi-leaf-shaped, hollow-hole-shaped, and indefinitely shaped. Of these cross-sectional shapes, a round-shaped cross section is particularly preferred.

The shape of the filamentary yarn can be a producer's yarn that is obtained by any one of the above various spinning methods, a false twisted yarn (including a drawn false twisted yarn of POY), a twisted false twisted yarn (for example, a yarn obtained by twisting in the S or Z direction at a rate of from 600 to 1,000 T/m, and false twisting in the Z or S direction at a rate of from 3,000 to 4,000 T/m), an air-jet texturized yarn and a mixed multifilament yarn. Forming a sewing thread from a producer's yarn or a false twisted yarn is preferred in order to obtain one excellent in sewing performance. Use of a producer's yarn is particularly preferred in order to obtain one excellent in lock stitching.

It is preferred that the poly(trimethylene terephthalate) multifilament yarn be a yarn having the following physical properties: a breaking strength of from 2.5 to 4.5 cN/dtex; a breaking elongation of from 34 to 60%; an initial elastic modulus of from 20 to 30 cN/dtex; an elastic recovery at a 20% elongation of from 60 to 95%; a stress at a 5% elongation of a tensile elongation curve of from 0.6 to 1.8 cN/dtex and a stress at a 30% elongation of from 2.3 to 3.5 cN/dtex; and a boil-off shrinkage of from 5 to 15%.

The total yarn size of the poly(trimethylene terephthalate) yarn is from 20 to 550 dtex, particularly preferably from 30 to 300 dtex. Moreover, the filament size thereof is 10 dtex or less, particularly preferably from 1 to 6 dtex.

In the present invention, the sewing thread is formed from a poly(trimethylene terephthalate) yarn. The sewing thread must show a stress at a 5% elongation of a tensile elongation curve of from 0.4 to 1.2 cN/dtex, preferably from 0.4 to 0.8 cN/dtex, a stress at a 30% elongation of from 1.4 to 2.2 cN/dtex, preferably from 1.4 to 2.0 cN/dtex. When the sewing thread is thus formed, the sewing performance of the sewing thread is enhanced, and preparation of sewn articles that are excellent in the uniformity of seams and wearability feeling can be realized. When the sewing thread shows a stress at a 5% elongation of less than 0.4 cN/dtex, there is a possibility that skip stitch or the like takes place. On the other hand, when the sewing thread shows a stress at a 5% elongation exceeding 1.2 cN/dtex, the uniformity of the seams is sometimes impaired. Moreover, when the sewing thread shows a stress at a 30% elongation of less than 1.4 cN/dtex, a seam tenacity sufficient for fabric sewn articles cannot be formed. On the other hand, when the sewing thread shows a stress at a 5% elongation exceeding 2.2 cN/dtex, the stress applied to the sewing thread becomes too large when the seams of a fabric sewn article is stretched, and it has been found that the sewn articles of clothing constrain the wearers and show a poor wearability. The sewing thread of the invention shows a breaking strength of from 2.3 to 4.5 cN/dtex, particularly preferably from 2.5 to 4.0 cN/dtex, and a breaking elongation of from 40 to 100%, particularly preferably from 50 to 80%. When the breaking strength is less than 2.3 cN/dtex, a sufficient seam tenacity is hardly given to the fabric sewn articles. On the other hand, when the breaking strength exceeds 4.5 cN/dtex, the sewing thread shows a low breaking elongation, and the seam stretchability of the fabric sewn articles becomes significantly low. As a result, the articles sometimes show a poor wearability. Moreover, when the breaking elongation is less than 40%, the seam stretchability of the fabric sewn articles becomes poor. As a result, the articles show a poor wearability. On the other hand, when the breaking elongation exceeds 100%, the sewing performance of the sewing thread is significantly impaired.

Furthermore, the sewing thread of the present invention shows an elastic recovery at a 20% elongation of 60% or more, particularly preferably from 60 to 80%. When a stretchable fabric is sewn using a sewing thread that shows an elastic recovery in the range mentioned above, the sewing thread shows an extremely excellent follow-up performance.

There is no specific restriction on the component size, number of doubling, number of twisting and direction of twisting of the sewing thread of the invention. The yarn number count can be suitably selected in accordance with the standard (JIS L 2511) related to the polyester filament sewing thread while the application and required specification are being taken into consideration. For example, the sewing thread can be suitably selected in accordance with the yarn count number #5, #8, #10, #20, #30, #40, #50, #60, #80 or #100.

When first twisting is to be applied to the poly (trimethylene terephthalate) filaments to form the sewing thread, the number of twists is preferably 500 to 1,200 T/m. Examples of the number of doubling are two fold yarn obtained by doubling and twisting two yarns, three ply yarn obtained by doubling and twisting three yarns, 2×3 ply yarn obtained by doubling and twisting three yarns each of which has been obtained by doubling and twisting two yarns. It is desirable that the number of final twisting be from 0.7 to 0.8 times that of first twisting to suppress the formation of a kinky yarn as much as possible. Moreover, the direction of final twisting should fundamentally be the Z direction. However, for sewing threads such as one for a two-needle lock stitch, both S twisting and Z twisting are preferably applied. Accordingly, there is no specific limitation on the direction of the final twisting.

A sewing thread of the present invention obtained by the following procedure is particularly preferred because the back sewing performance in a lock stitch is extremely excellent: a poly(trimethylene terephthalate) producer's multifilament yarn of from 20 to 150 dtex is first twisted at a rate of from 500 to 1,000 T/m in the Z direction; two to three of the yarns are then doubled, and intermediate twisted is imparted at a rate of from 1,000 to 2,000 T/m in the S direction; and two or three of the doubled and twisted yarns are doubled and final twisted at a rate of 300 to 800 T/m in the Z direction. On the other hand, a sewing thread obtained by doubling two false twisted yarns each prepared from a poly(trimethylene terephthalate) producer's filaments yarn of from 50 to 200 dtex and twisting at a rate of 100 to 300 T/m.

Next, the method of producing a sewing thread of the present invention will be explained.

The sewing thread of the invention can be produced by the following procedure: poly(trimethylene terephthalate) producer's multifilament yarn or texturized yarns each having the physical properties explained above and a desired size of 20 dtex or more are doubled and twisted, or the doubled and twisted yarns doubling are doubled and further doubled and twisted to give a twist composite yam (hereinafter merely referred to as twist doubled yarn); the twist doubled yarn in a yarn package with a density of from 0.25 to 0.5 g/cm$^3$ is wet heat treated at 90° C. or above.

Herein, the number of doubling of filaments yarns, the number of doubling and twisting and the twisting direction applied in doubling and twisting, the number of twisting, and the like are suitably selected in accordance with the design and specification of a known sewing thread, and a twist doubled yarn composed of a given number of ply is prepared using a known doubling and twisting frame such as an Italian throwing machine.

The yarn package of the twist doubled yarn is a cone or cheese of the twist doubling yarn that is wound on a bobbin such as a paper bobbin by winding means such as a soft winding machine in the final step of the union twisting, and that has a given density of wounding.

When the twist doubled yarn of the poly(trimethylene terephthalate) filaments yarns in the shape of a yarn package having a specific density of wounding is wet heat treated, a sewing thread that shows a stress at a 5% elongation of a tensile elongation curve of from 0.4 to 1.2 cN/dtex, and a stress at a 30% elongation of from 1.4 to 2.2 cN/dtex, that is uniform in the thread direction, and that exhibits stabilized stretchability (physical properties) can be obtained.

The wet heat treatment is carried out by penetratively circulating overheated steam or water at 90° C. or above around the yarn package layer for 10 minutes or more. It is convenient and most preferred to carry out not only the wet heat treatment but also scouring or dyeing of the sewing thread using a package scouring machine or a dyeing machine. Circulation of a wet heat treatment medium around the union twisted yarn layer having a given density of a yarn package in an out-in or in-out manner for a given time can uniformly relax without disturbing the layer, and adjust the structure and physical properties of the surface and inner layer portions of the sewing thread to predetermined conditions. It is important that the yarn package of the union twisted yarn, to be wet heat treated, be formed to have a density of winding of from 0.25 to 0.5 g/cm$^3$. When the density of winding is less than 0.25 g/cm$^3$, the following disadvantages results: the shape of the yarn package becomes unstable and tends to collapse within a package scouring machine or a dyeing machine; the sewing thread can be relaxed, but the relaxation becomes nonuniform; and there is a possibility that the union twisted yarn is unevenly dyed or has nonuniform physical properties when the union twisted yarn is dyed because a uniform flow of the dyeing solution is not effected. On the other hand, when the density of wounding exceeds 0.5 g/cm$^3$, the density of wound of the yarn package becomes high due to the thermal shrinkage of the sewing thread during scouring and dyeing, and the inner and outer layers of the yarn package tend to have uneven dyeing and nonuniform physical properties because the flowability of the dyeing solution is suppressed. In order to obtain sufficient relaxation heat treatment, even dyeing and uniform physical properties by package scouring and dyeing, the following methods are appropriate, in addition to employing a yarn package having a density of winding of from 0.25 to 0.5 g/cm$^3$: a method comprising soft winding the sewing thread on a bobbin (to be buckled) to form a cheese with a suitable density of winding as mentioned above, the method preventing an increase in the density of winding of the yarn package during package dyeing caused by a thread shrinkage, by means of bobbin buckling; and a method comprising replacing the bobbin on which the yarn package having a predetermined density of winding is wound with a perforated tube bobbin with perforation having a replaced bobbin ratio of from 5 to 30%, preferably from 10 to 20%, and wet heat treating the yarn package.

The replaced bobbin ratio (%) herein is a value obtained by the following formula:

$$(1-[B/A])\times 100$$

wherein A is an outer diameter of a winding bobbin such as the winding paper bobbin of a winding machine, and B is an outer diameter of a perforated tube bobbin.

In order to improve the cohesiveness or integrity and sewing performance of a sewing thread, a solution containing a sewing performance improver, a smoothing agent and a binder may be circulated around the yarn package having been scoured or dehydrated after dyeing so that the agents are allowed to adhere thereto. Alternatively, these agents may also be allowed to adhere to the yarn package having been wet treated, dyed and dried by a continuous yarn treating machine (an apparatus for allowing a solution containing processing agents to adhere to the yarn while the yarn is being continuously unwound from the yarn package, drying and winding the yarn: for example, Unisizer (trade name, manufactured by Kaji Seisakusho K.K.). Examples of the sewing performance improver and the smoothing agent include silicone compounds, polyethylene-based emulsions and wax compounds. Examples of the binder include polyester-based resins, polyurethane-based resins and acrylate-based resins.

A method of conducting wet heat treatment of a twist doubling yarn by means of scouring is a method comprising treating the yarn with a scouring solution containing such scouring agents for removing lubricants on the yarn as nonionic surfactants and sodium carbonate at temperature from 50 to 100° C. for 10 to 30 minutes. A method of conducting wet heat treatment of a twist doubling yarn by means of dyeing is a method comprising circulating, after scouring the twist doubled yarn, a dyeing solution containing dispersion dyes, dispersants and acetic acid in an out-in manner, an in-out manner or an out-in-in-out manner around the yarn package at temperature from 90 to 130° C. for 15 to 120 minutes, more preferably at 110 to 130° C. A dyed sewing thread having predetermined uniform physical properties can be obtained by the method in a shorter period of time. A sewing thread obtained by package dyeing under the following conditions is particularly preferred because uniformity of dyeing and uniformity of the physical properties of the thread brought about by wet heat treatment are simultaneously achieved: a density of wounding of the yarn package of from 0.25 to 0.5 g/cm$^3$, particularly from 0.3 to 0.4 g/cm3; and a replaced bobbin ratio (replacement with a dyeing tube (perforated tube bobbin)) of from 5 to 30%, particularly from 10 to 20%.

A stretchable fabric in the present invention signifies a fabric that shows an extensibility in the warp and/or weft direction of from 5 to 200%. The extensibility herein is obtained by the following procedure: two samples having dimensions of 140 mm×165 mm (tensile side×constraint side) with the tensile side of one sample taken in the warp direction of the fabric and that of the other sample taken in the weft direction are prepared; each sample is pulled at a rate of 60 cm/min so that a tensile elongation curve is depicted; an elongation of the fabric sample to which a stress of 2 kg/5 cm width is applied is measured from the curve. In addition, a biaxial elongating machine (trade name of KES-G2, manufactured by Kato Tech K.K.) is used for the measurement. Examples of fabric include a woven fabric, a knitted fabric and a nonwoven fabric. Of the fabrics, a woven fabric and a knitted fabric are especially preferred. Means for applying stretchability to these fabrics include a procedure that utilizes the stretchability of yarns forming the fabric, a procedure that utilizes the stretchability of the texture of the fabric, and a procedure that utilizes a combination of the above two procedures.

Specific examples of the means include a procedure that utilizes a bare polyurethane-based yarn and a composite yarn such as a covered yarn, a procedure that utilizes the stretchability of a yarn obtained by crimping the yarn by means of false twisting, and a procedure that is a combination of these procedures. Typical examples of applying stretchability to a texture include tubular knitting, warp knitting and weft knitting. Specific examples of the stretchable fabric of the invention include clothes showing an extensibility of from 10 to 25% such as shirts, blouses, working clothes, uniforms, slacks, jackets, suits and coats, clothes showing an extensibility of from 20 to 40% such as sports jackets, training wear, play wear, T-shirts, underwear and sweaters, and clothes showing an extensibility of from 40 to 200% such as foundation garments, leotards, swimwear, skiwear and skate wear. Although the sewing thread of the invention can be used for sewing all these stretchable fabrics, use of fabrics showing an extensibility of 20% or more, particularly 60% or more is preferred because the seams are excellent in stretchability and the sewn articles thus obtained do not constrain the wearers and show excellent wearability.

BEST MODE FOR CARRYING OUT THE INVENTION

The present invention will be explained below by making reference to examples. In addition, evaluations in examples are made by the following procedures.

(1) Evaluation of Tensile Elongation

Using a tensilometer (trade name of Tensilon, manufactured by Toyo Baldwin K.K.), a tensile elongation curve is depicted under the conditions of a sample length of 20 cm and a tensile speed of 20 cm/min, and the stress at a 5% elongation and a 30% elongation, the breaking strength (cN/dtex) and the breaking elongation (%) are measured.

(2) Measurement of Initial Elastic Modulus

The initial elastic modulus is measured in accordance with JIS L-1013.

(3) Evaluation of Elastic Recovery

An initial load of 0.0109 cN/dtex is applied to a sample, and a stress-strain curve is depicted by elongating the sample at a constant rate of 20% min until the sample is elongated by 20%, and conversely shrinking the sample at the same rate. The elastic recovery at a 20% elongation is calculated from the following formula:

$$\text{elastic recovery at a 20\% elongation}=(20-L)/20\times100(\%)$$

wherein L is a residual elongation when the stress is lowered during shrinking to 0.0109 cN/dtex that is equal to the initial load.

(4) Measurement of $\eta_{sp}/c$

A polymer is dissolved in o-chlorophenol at 90° C. at a concentration of 1 g/dl. The solution thus obtained is transferred to an Ostwald viscometer, and measured at 35° C. $\eta_{sp}/c$ is calculated from the following formula:

$$\eta_{sp}/c=(T/T_0-1)/C$$

wherein T is a drop time (sec) of the sample solution, $T_0$ is a drop time (sec) of the solvent, and C is a concentration (g/dl) of the solution.

(5) Evaluation of Sewn Articles

① Evaluation of Stretchability of Seams

Using a tubular knitting machine of 28 GG, a ponti roma texture is knitted by the following yarn arrangement.

Interlock portion:

a mixed filaments yarn of poly(ethylene terephthalate) (cation dyeable yarn) of 56 dtex/cuprammonium rayon of 33 dtex Gray sheeting portion of cylinder:

a mixed filaments yarn of poly(ethylene terephthalate) (cation dyeable yarn) of 56 dtex/cuprammonium rayon of 33 dtex Gray sheeting portion of dial:

a polyurethane-based elastic yarn (trade name of Roica, manufactured by Asahi Chemical Co., Ltd.) of 22 dtex and the same mixed filaments yarn as in the interlock portion being doubled and fed while the polyurethane-based elastic yarn is being elongated by a ratio of 2.5.

The knitted fabrics thus formed were each scoured, preset (at 180° C.), dyed at 100° C. for 30 minutes in two baths, and finished at 170° C. The stretch ratio of the stretchable knitted fabric (hereinafter referred to as a knitted fabric) thus obtained was measured with a biaxial stretching machine (manufactured by Kato Tech K.K.). The fabric showed a stretch ratio of 140.0% in the warp direction, and 88.5% in the weft direction under the testing condition of 2 kg/5 cm.

A sample having dimensions of 10 cm (warp)×20 cm (weft) is taken from the knitted fabric. The central portion of the sample is sewn in the warp direction using a lock stitch machine (trade name of DDL-555, manufactured by JUKI Corporation) under the following conditions: a J point needle (No. 11) as a sewing needle; a stitch number of 5 stitches/cm; and a rotation number of 3,000 rpm. Using a tensilometer (trade name of Tension, manufactured by Toyo Baldwin K.K.), the sample is elongated in the direction parallel to the seam, in accordance with the grab method by JIS L-1093, and a stress A (cN/cm) at an elongation of 60% and an elongation of 100% are measured. Next, a knitted fabric prior to sewing is elongated in the same manner, and a stress B (cN/cm) at an elongation of 60% and an elongation of 100% are measured.

The stretchability of the seam is evaluated from a difference between both values (stress A–stress B) at an elongation of 60% and an elongation of 100%. When the value is small, the stretchability is excellent.

② Evaluation of Wearability

Using a knitted fabric obtained in ①, spats are prepared under the following conditions.

Size: No. 9

Grain: weft direction,

Allowance: −5%

Sewing conditions lock stitches: a sewing machine manufactured by Juki Corporation (trade name of DDL-555)
sewing needle: a J point needle (No. 11)
stitch number: 5 stitches/cm
number of rotation: 3,000 rpm Five panelists each having standard body dimensions are selected. They wear the above spats, go up and down stairs, bend and stretch, and each pedal a bicycle. The wearability during their action is evaluated in accordance with the following criteria: ◎ (extremely comfortable), ○ (comfortable), Δ (slightly comfortable) and × (uncomfortable).

③ Appearance of Seams

Using a knitted fabric obtained in ①, the appearance of the seam is visually evaluated under the following criteria:

○: the seam is uniform, and neither skip ditch nor puckering is observed;

Δ: the seam is nonuniform; and

×: either a skip ditch or puckering is present.

EXAMPLE 1

A poly(trimethylene terephthalate) ($\eta_{sp}/c=0.8$) was spun at a spinning temperature of 265° C. and a spinning rate of 1,200 m/min to give an undrawn yarn. The undrawn yarn was then drawn by draw-twister at a hot roll temperature of 60° C., a hot plate temperature of 140° C., a draw ratio of 3 and a drawing rate of 800 m/min to give a drawn yarn of 84 dtex/36 f. The drawn yarn showed a breaking strength of 3.5 cN/dtex, a breaking elongation of 40%, an initial elastic modulus of 24 cN/dtex and an elastic recovery at a 20% elongation of 95%.

One of the poly(trimethylene terephthalate) flat yarns thus obtained was first twisted at a rate of 800 t/m (S direction) with an Italian throwing machine. Three of such yarns were doubled, and final twisted at a rate of 600 t/m (Z direction) to give a three ply yarn. The three ply yarn thus obtained was wound on a paper bobbin having a diameter of 79 mm at a density of winding of 0.35 g/cm$^3$ (1 kg of coil) using a soft winder (manufactured by Kozu K.K.). The paper bobbin of the cheese was replaced with a dyeing tube (perforated tube bobbin) having an outer diameter of 69 mm, and the dyeing tube was placed in a package dyeing machine (manufactured by Nichihan Seisakusho K.K.). Scourol FC 250 (trade name, manufactured by Kao Corporation) was added to the scouring solution in an amount of 1 g/l, and the solution was heated to 60° C. from room temperature at a rate of 2° C./min while the solution was being allowed to flow at a rate of 40 l/min, followed by scouring the cheese at 60° C. for 10 minutes. The solution was then removed, and the cheese was washed with water. Dispersion dyes (trade name of Dianix Yellow AC-E (0.06% o.w.f.), Dianix Blue AC-E (0.08% o.w.f.) and Dianix Red AC-E (0.06% o.w.f.), manufactured by Dye Star K.K.) and a dispersant (trade name of Disper TL (0.5 g/l), manufactured by Meisei Kagaku K.K.) were added to the dyeing solution, and the pH was adjusted to 5 with acetic acid. The dyeing solution was heated to 120° C. at a rate of 2° C./min while being circulated in an in-out manner at a flow rate of 40 l/min, and the cheese was dyed at 120° C. for 30 minutes. The solution was removed, and the cheese was washed with water. A silicone lubricant (trade name of Dicsilicone Softener 500, manufactured by Dainippon Ink and Chemicals Incorporated) (5% o.w.f.) was added, and the cheese was subjected to oiling treatment at 50° C. for 20 minutes. The cheese was dehydrated, and dried to give a sewing thread corresponding to #50. The sewing thread thus obtained showed a breaking strength of 3.4 cN/dtex, a breaking elongation of 72%, an elastic recovery at a 20% elongation of 66%, a stress at a 5% elongation of a tensile elongation curve of 0.6 cN/dtex and a stress at a 30% elongation of 1.8 cN/dtex.

The sewing thread showed excellent uniform dye-affinity and uniform physical properties. Seams prepared using the sewing thread showed an excellent appearance and excellent stretchability. Sewn articles prepared using the sewing thread did not constrain the wearers, and gave them a comfortable feel. Table 1 shows the results of evaluating the sewing thread.

EXAMPLE 2

A poly(trimethylene terephthalate) drawn yarn of 56 dtex/24 f was obtained in the same manner as in Example 1. The drawn yarn showed a breaking strength of 3.4 cN/dtex, a breaking elongation of 38%, an initial elastic modulus of 23 cN/dtex and an elastic recovery at a 20% elongation of 92%.

One of the poly(trimethylene terephthalate) flat yarns thus obtained was first twisted at a rate of 800 t/m (Z direction) with an Italian throwing machine. Two of such yarns were doubled, and intermediate twisted at a rate of 1,700 t/m (S direction); three of such intermediate twisted yarns were doubled, and final twisted at a rate of 600 t/m (Z direction) to give a six ply yarn. The six ply twist yarn thus obtained was treated in the same manner as in Example 1 except that the density of winding of the cheese and the replaced bobbin ratio were changed during cheese dyeing as listed in Table 1 to give a sewing thread corresponding to #40 showing a breaking strength, a breaking elongation, an elastic recovery at a 20% elongation and a tensile elongation curve listed in Table 1.

The sewing thread showed excellent uniform dye-affinity and uniform physical properties. Seams prepared using the sewing thread showed an excellent appearance and excellent stretchability. Sewn articles prepared using the sewing thread did not constrain the wearers, and gave them a comfortable feel. Table 1 shows the results of evaluating the sewing thread.

EXAMPLE 3

A poly(trimethylene terephthalate) drawn yarn of 110 dtex/48 f was obtained in the same manner as in Example 1. The drawn yarn showed a breaking strength of 3.4 cN/dtex, a breaking elongation of 42%, an initial elastic modulus of 23 cN/dtex and an elastic recovery at a 20% elongation of 94%.

The poly(trimethylene terephthalate) flat yarn thus obtained was false twisted at a yarn speed of 190 m/min, a false-twisting number of 2,900 T/m, a false-twisting temperature of 165° C., a first feed of 0.0% and a TU feed of 3.5% using a pin-type false twisting machine (trade name of IVF 338, manufactured by Ishikawa Seisakusho, Ltd.). Two of such false twisted yarns obtained were union twisted at a rate of 150 t/m (Z direction) with an Italian throwing machine. The union twisted yarn thus obtained was treated in the same manner as in Example 1 except that the density of winding of the cheese and the replaced bobbin ratio during cheese dyeing were changed as listed in Table 1 to give a sewing thread corresponding to #50 showing a breaking strength, a breaking elongation, an elastic recovery at a 20% elongation and a tensile elongation curve listed in Table 1.

The sewing thread showed excellent uniform dye-affinity and uniform physical properties. Seams prepared using the sewing thread showed an excellent appearance and excellent stretchability. Sewn articles prepared using the sewing thread did not constrain the wearers, and gave them a comfortable feel. Table 1 shows the results of evaluating the sewing thread.

EXAMPLES 4 to 5

The procedure of Example 1 was repeated except the density of winding of the cheese and the replaced bobbin ratio during cheese dyeing were changed as listed in Table 1 to give sewing threads each showing a breaking strength, an elastic recovery at a 20% elongation and a tensile elongation curve listed in Table 1.

The sewing threads showed excellent uniform dye-affinity and uniform physical properties. Seams prepared using the sewing threads showed an excellent appearance and excellent stretchability. Sewn articles prepared using the sewing threads did not constrain the wearers, and gave them a comfortable feel. Table 1 shows the results of evaluating the sewing threads.

Comparative Example 1

Yarns were twisted and cheese dyed in the same manner as in Example 1 except that a poly(ethylene terephthalate) multifilament flat yarn of 84 dtex/36 f (manufactured by Asahi Chemical Industry Co., Ltd., showing a breaking strength of 5.0 dtex/f, a breaking elongation of 18%, an initial elastic modulus of 97 dtex/f and an elastic recovery at a 20% elongation of 45%) was used in place of the poly (trimethylene terephthalate) multifilament flat yarn in Example 1. As a result, a sewing thread that showed a breaking strength, a breaking elongation, an elastic recovery at a 20% elongation and a tensile elongation curve listed in Table 1 and that corresponded to #50 was obtained.

Table 1 shows the results of evaluating sewn articles prepared using the sewing thread. Seams prepared using the sewing thread showed a poor stretchability because the sewing thread had been prepared from poly(ethylene terephthalate) multifilament yarn. Sewn articles prepared using the sewing thread significantly constrained the wearers, and gave them an uncomfortable feel.

Comparative Example 2

Yarns were twisted in the same manner as in Example 1 except that a nylon 66 multifilament flat yarn of 78 dtex/24 f (manufactured by Asahi Chemical Industry Co., Ltd., showing a breaking strength of 6.0 dtex/f, a breaking elongation of 25%, an initial elastic modulus of 40 cN/dtex and an elastic recovery at a 20% elongation of 60%) was used in place of the poly(trimethylene terephthalate) multifilament flat yarn, and cheese dyeing was conducted in the same manner as in Example 1 except that an acid dye was used at 110° C. As a result, a sewing thread that showed a breaking strength, a breaking elongation, an elastic recovery at a 20% elongation and a tensile elongation curve listed in Table 1 and that corresponded to #50 was obtained.

Table 1 shows the results of evaluating sewn articles prepared using the sewing thread. Seams prepared using the sewing thread showed poor stretchability. The sewn articles significantly constrained the wearers, and gave them an uncomfortable feel.

Comparative Example 3

A sewing thread showing a breaking strength, a breaking elongation, an elastic recovery at a 20% elongation and a tensile elongation curve listed in Table 1 was obtained in the same manner as in Example 1 except that the density of winding of the cheese and the replaced bobbin ratio during cheese dying were changed as listed in Table 1. The sewing thread showed a low density of winding, uneven dyeing due to the shoulder collapsed cheese during package dyeing produced by a high replaced bobbin ratio, poor uniformity of dye-affinity and nonuniform physical properties.

Table 1 shows the results of evaluating sewn articles prepared using the sewing thread. Skipped stitches often occurred during sewing, and the seam appearance was poor.

Comparative Example 4

A poly(trimethylene terephthalate) ($\eta_{sp}/c$=1.4) was spun at a spinning temperature of 265° C. and a spinning rate of 2,500 m/min to give an undrawn yarn. The undrawn yarn was then drawn by draw-twister at a hot roll temperature of 60° C., a hot plate temperature of 140° C., a draw ratio of 1.5 and a drawing rate of 300 m/min to give a drawn yarn of 84 dtex/36 f. The drawn yarn showed a breaking strength of 5.5 cN/dtex, a breaking elongation of 23%, an initial elastic modulus of 26 cN/dtex and an elastic recovery at a 20% elongation of 98%.

The poly(trimethylene terephthalate) filaments raw yarn thus obtained was twisted in the same manner as in Example 1, and directly wound on a dyeing tube. A sewing thread showing a breaking strength, a breaking elongation, an elastic recovery at a 20% elongation and a tensile elongation curve listed in Table 1 was obtained in the same manner as in Example 1 except for the density of winding shown in Table 1. The sewing thread was not relaxed substantially because the density of winding was high and the replaced bobbin ratio was set at 0%. Moreover, the dyeing solution showed poor penetration into the cheese during cheese dyeing, and the cheese showed uneven dyeing and a difference in physical properties between the inner and outer layers, thus showing poor uniformity.

Table 1 shows the results of evaluating sewn articles prepared using the sewing thread. The sewing thread showed a poor sewing performance. The seams showed a nonuniform appearance, and poor stretchability. The sewn articles thus obtained significantly constrained the wearers, and gave them an uncomfortable feel.

TABLE 1

| | Cheese dyeing conditions | | Physical properties of sewing thread | | | | | | | | |
|---|---|---|---|---|---|---|---|---|---|---|---|
| | Denstity of wounding g/cm³ | Replaced bobbin ratio % | Stress at 5%* cN/dtex | Stress at 30%* cN/dtex | Elastic recovery at 20%* % | Breaking str** cN/dtex | Breaking elongation % | Stretchability of seam (cN/dtex) At 60%* | Stretchability of seam (cN/dtex) At 100%* | App. of seam+ | Wearability |
| Ex. 1 | 0.35 | 12.7 | 0.6 | 1.8 | 66 | 3.4 | 72 | 100 | 160 | ○ | ◎ |
| Ex. 2 | 0.33 | 15.0 | 0.5 | 1.6 | 66 | 3.1 | 77 | 90 | 150 | ○ | ◎ |
| Ex. 3 | 0.31 | 10.0 | 0.6 | 1.9 | 70 | 2.6 | 55 | 100 | 170 | ○ | ◎ |
| Ex. 4 | 0.35 | 20.0 | 0.4 | 1.4 | 61 | 3.2 | 83 | 80 | 120 | ○ | ◎ |
| Ex. 5 | 0.40 | 10.0 | 1.2 | 2.2 | 80 | 3.5 | 51 | 170 | 220 | ○ | ○ |
| C.E. 1 | 0.35 | 12.7 | 1.3 | Broken | 41 | 4.9 | 20 | 400 | Broken | ○ | X |
| C.E. 2 | 0.35 | 12.7 | 0.5 | 4.7 | 55 | 5.8 | 44 | 260 | 460 | ○ | X |
| C.E. 3 | 0.20 | 30.0 | 0.3 | 1.3 | 58 | 3.0 | 85 | 60 | 100 | X | ◎ |
| C.E. 4 | 0.60 | 0.0 | 1.3 | 2.4 | 75 | 4.6 | 38 | 220 | 270 | X | X |

Note:
*at w % = at w % elongation
str = strength
+App. of seam = Apperance of seam

INDUSTRIAL APPLICABILITY

The sewing thread of the present invention is a stretchable one that is excellent in sewing performance, and that makes a seam excellent in appearance and stretchability, and that exhibits excellent adaptability to sewing a stretchable fabric. In sewn articles obtained by using the sewing thread of the invention, seams of stitched portions excellent in dynamic follow-up performance are formed. The present invention can therefore provide sewn articles of clothing that headly constrain the wearers and that give them a comfortable feel. The use of the sewing thread of the invention can provide stretchable fabric sewn articles having seams that can dynamically follow the stretching and shrinking of stitched fabric and that are excellent in aesthetic appearance.

What is claimed is:

1. A sewing thread formed from poly(trimethylene terephthalate) multifilament yarns, characterized in that the sewing thread shows a stress at a 5% elongation of a tensile elongation curve of from 0.4 to 1.2 cN/dtex and a stress at a 30% elongation of from 1.4 to 2.2 cN/dtex.

2. A sewing thread according to claim 1, wherein the sewing thread shows a breaking strength of from 2.3 to 4.5 cN/dtex and a breaking elongation of from 40 to 100%.

3. A sewing thread according to claim 1, wherein the sewing thread shows an elastic recovery at an elongation of 20% of 60% or more.

4. A fabric sewn article having seams formed using a sewing thread according to any one of claims 1 to 3.

5. A stretchable fabric sewn article having seams formed using a sewing thread according to any one of claims 1 to 3.

6. A method of producing a sewing thread comprising the steps of: doubling poly(trimethylene terephthalate) multifilament yarns having a predetermined size of 20 dtex or more to give a union twisted yarn; further doubling the union twisted yarns if necessary; and wet heat treating the union twisted yarn in a yarn package state having a density of winding of from 0.25 to 0.5 g/cm³ at temperature of 90° C. or more.

7. The method of producing a sewing thread according to claim 6, wherein the wet heat treatment is conducted by package scouring or package dyeing.

8. The method of producing a sewing thread according to claim 6, wherein the yarn package is wet heat treated on a perforated bobbin having a replaced bobbin ratio of from 5 to 30%.

9. A method of producing a sewing thread comprising the steps of: first twisting and/or intermediate twisting a given number of poly(trimethylene terephthalate) multifilament yarns having a size of 20 dtex or more; doubling the resultant yarns and final twisting the doubled yarns, whereby a twisted yarn is prepared; and wet heat treating the twisted doubled yarn in a yarn package state having a density of winding of from 0.25 to 0.5 g/cm³ at temperature of 90° C. or more.

10. The method of producing a sewing thread according to claim 6, wherein a poly(trimethylene terephthalate) multifilament yarn having a size of from 30 to 150 dtex is twisted at a rate of from 500 to 1,000 T/m in the Z direction, two or three of the resultant yarns are doubled and twisted at a rate of from 1,000 to 2,000 T/m in the S direction, two or three of the resultant yarns are doubled and final twisted at a rate of from 300 to 800 T/m in the Z direction, the resultant union twisted yarn is wet heat treated at temperature of 90° C. or more.

* * * * *